United States Patent [19]

Sagara et al.

[11] Patent Number: 4,799,662

[45] Date of Patent: Jan. 24, 1989

[54] SHEET FEEDING DEVICE

[75] Inventors: Seiji Sagara; Hiroyoshi Maruyama, both of Yokohama; Hiroyuki Miyake, Inagi; Nobuhiro Kasama, Yokohama; Shinichi Tanada, Machida; Kazuo Kagiura, Tokyo; Takaji Yonemori, Tokyo; Yuji Hasegawa, Tokyo, all of Japan

[73] Assignee: Canon Kabushiki Kaisha, Tokyo, Japan

[21] Appl. No.: 154,508

[22] Filed: Feb. 5, 1988

Related U.S. Application Data

[63] Continuation of Ser. No. 856,845, Apr. 21, 1986, abandoned, which is a continuation of Ser. No. 534,666, Sep. 22, 1983, abandoned.

[30] Foreign Application Priority Data

Sep. 29, 1982 [JP] Japan ..... 57-168437
Nov. 19, 1982 [JP] Japan ..... 57-202088

[51] Int. Cl.[4] ..... B65H 3/06
[52] U.S. Cl. ..... 271/114; 271/164
[58] Field of Search ..... 271/114, 116, 109, 21, 271/22, 16, 17, 4, 6, 10, 164

[56] References Cited

U.S. PATENT DOCUMENTS

| | | | |
|---|---|---|---|
| 3,021,136 | 2/1962 | Fox | 271/114 |
| 3,165,312 | 1/1965 | Stoever | 271/114 |
| 3,575,410 | 4/1971 | Suzuki | 271/114 |
| 4,097,041 | 6/1978 | Fujimoto | 271/114 |
| 4,098,501 | 7/1978 | Tani et al. | 271/164 |
| 4,176,834 | 12/1979 | Takahashi | 271/116 |
| 4,248,415 | 2/1981 | Steinhilber | 271/9 |
| 4,268,026 | 5/1981 | Kojima | 271/109 |
| 4,351,519 | 9/1982 | Vendrick | 271/164 |
| 4,449,705 | 5/1984 | Shibuya et al. | 271/164 |

FOREIGN PATENT DOCUMENTS

| | | | |
|---|---|---|---|
| 0065306 | 11/1982 | European Pat. Off. | 271/10 |
| 703396 | 10/1934 | France | 271/109 |
| 132235 | 10/1981 | Japan | 271/114 |
| 0011438 | 1/1983 | Japan | 271/116 |

*Primary Examiner*—Joseph J. Rolla
*Assistant Examiner*—Kenneth Noland
*Attorney, Agent, or Firm*—Fitzpatrick, Cella, Harper & Scinto

[57] ABSTRACT

This specification discloses a sheet feeding device for feeding sheets from a sheet supporting bed such as a cassette or a deck, and more particularly a sheet feeding device having a sheet supporting bed holding sheets thereon and adapted to be removably mounted at a predetermined position in an image forming apparatus, a rotatable member for contacting the sheets on the sheet supporting bed and feeding the sheets when the sheet supporting bed is mounted at the predetermined position in the image forming apparatus, support means for supporting the rotatable member for idle rotation by a predetermined amount in a forward direction and a reverse direction, and intermittent means for intermittently connecting the support means to a drive source. The sheet supporting bed includes, for example, a cassette type one which can be perfectly removed from the image forming apparatus or, for example, a drawing type one which can be pulled out and inserted relative to the predetermined position while remaining engaged with the image forming apparatus.

12 Claims, 12 Drawing Sheets

SHEET FEEDING DEVICE

This application is a continuation of application Ser. No. 856,845 filed Apr. 21, 1986, which in turn was a continuation of application Ser. No. 534,666 filed Sept. 22, 1983, both now abandoned.

BACKGROUND OF THE INVENTION

1. Field of the Invention

This invention relates to a sheet feeding device for feeding sheets from a sheet supporting bed such as a cassette or a deck, and more particularly to a sheet feeding device in which the mounting or dismounting operation of the sheet supporting bed can be well accomplished without the sheets being wrinkled even if a rotatable member contacts the sheets held on the sheet supporting bed when the sheet supporting bed is loaded into or removed from a predetermined position in an image forming apparatus.

2. Description of the Prior Art

Sheet feeding devices have heretofore been very commonly used which are designed such that a number of sheets are contained in a cassette having an open top and the sheets are resiliently biased from the underside thereof toward the open top side and when the cassette is mounted in a copying apparatus body or the like, a paper feed roller disposed on the body side is urged against the uppermost sheet in the cassette and also the roller is driven to feed the sheets one by one to the body side.

In the sheet feeding devices of this type, the paper feed roller disposed on the body side of the copying apparatus or the like is normally urged against the uppermost sheet held relatively loosely in the cassette and therefore, even if the drive force to the paper feed roller is cut off during the non-operative condition of the apparatus, the cassette must be drawn out against a great rotational torque required for rotating the paper feed roller when the cassette is to be removed from the body for some reason or other and therefore, there is an undesirable possibility that the uppermost sheet and plural sheets adjacent thereto in the cassette are deviated from a predetermined position in the cassette or damaged.

To avoid such a danger, the sheet feeding device has unavoidably been designed such that when the cassette is to be mounted or dismounted with respect to the copying apparatus body, the cassette is mounted or dismounted in such a direction that the sheets in the cassette do not contact the paper feed roller in the body and in a predetermined position, the cassette is somewhat pivotally moved to bring the paper feed roller into contact with the sheets, or that the cassette is mounted or dismounted with the paper feed roller on the body side permitted to escape and the paper feed roller is urged against the sheets in the cassette when the cassette has been brought to the predetermined position.

However, in the case of the former design, a part of the cassette is disposed in the interior of the body and a space in which pivotal movement can occur is required near the portion in which the paper feed roller is disposed, and this means that a space directly unnecessary for copying or printing operation is required and thus, the body becomes bulky and the operation of setting the cassette unavoidably becomes cumbersome because the cassette must be set at a predetermined position after being inserted into the body. Also, in the case of the latter design, the paper feed roller is provided with a mechanism for driving the same and therefore, making these portions movable results in a complicated construction and reduced reliability, and apparently, this is not preferable.

SUMMARY OF THE INVENTION

It is an object of the present invention to provide a sheet feeding device which can be easily mounted and dismounted and which is high in reliability.

It is another object of the present invention to provide a sheet feeding device which does not increase the required space of the body of an image forming apparatus.

It is still another object of the present invention to provide a sheet feeding device which permits a sheet supporting bed such as a cassette to be mounted and dismounted in a plane with respect to the body.

It is yet another object of the present invention to provide a sheet feeding device which does not wrinkle or disturb sheets when a sheet supporting bed such as a cassette is mounted or dismounted.

It is a further object of the present invention to provide a sheet feeding device which is also applicable to a high-speed copying apparatus or printer.

A further object of the present invention is to prevent sheet deviation from a predetermined position even if the sheets are oblique or rotated when inserted into or removed from apparatus such as image forming apparatus.

The invention will become fully apparent from the following detailed description thereof taken in conjunction with the accompanying drawings.

DESCRIPTION OF THE PREFERRED EMBODIMENTS

The invention will hereinafter be described in greater detail with respect to an embodiment thereof. The following embodiment will be described by taking as an example a cassette perfectly removable from an image forming apparatus, but of course, the present invention is not restricted thereto.

Figure 1:
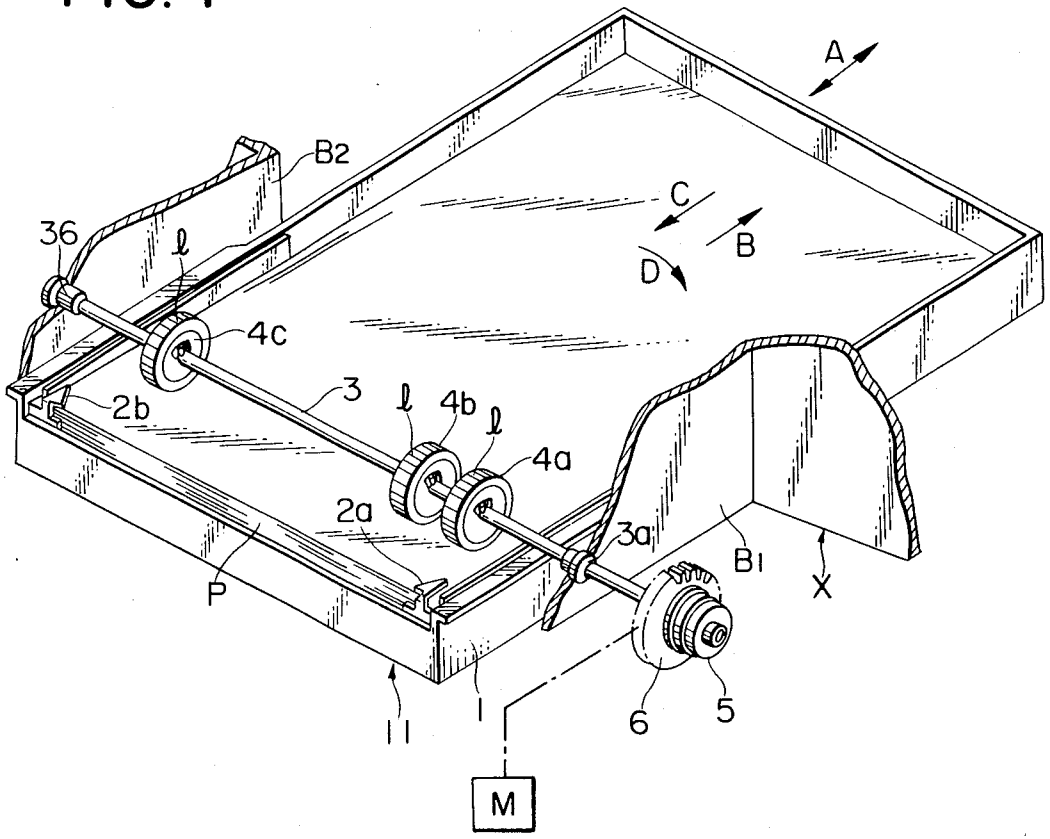
FIG. 1 is a perspective view showing the construction of a sheet feeding device to which an embodiment of the present invention is applied.

Referring to FIG. 1, reference characters B1 and B2 designate members forming a cassette mounting portion formed on the side of an image forming apparatus such as a printer, and it is to be understood that a cassette 1 is inserted and removed in the directions of double-headed arrow A between these members.

FIG. 1 shows the cassette 1 as mounted at a paper feeding position in the copying apparatus body. In this position, a shaft 3 rotatably disposed at a fixed position on the side of the body X through bearings 3*a* and 3*b* is positioned near the forward end of sheets P in the cassette 1.

The sheets P in the cassette 1 are biased toward the open upper surface of the cassette by a spring, not shown, disposed between the bottom 11 of the cassette and an intermediate plate (not shown), and the uppermost position of the sheets is restricted by separating pawls 2*a* and 2*b* which control the forward end of the sheets P. Thus, the vertical position of the uppermost sheet is maintained constant irrespective of the quantity of the sheets P. A suitable number (three in the shown embodiment) of circular paper feed rollers 4*a*, 4*b* and 4*c* are mounted on the shaft 3 for rotation relative to the shaft 3. That is, the paper feed rollers 4*a* and 4*c* are disposed at positions opposed to one end of the cassette 1 so that they are in contact with the uppermost sheet near the end of the sheets P in the cassette 1, and the roller 4*b* is provided near the roller 4*a*. These rollers are plastic rollers having their peripheral surface covered with rubber l and are rotatable with low friction relative to the shaft 3 made of a metal such as iron. An electromagnetic clutch 5 is disposed on one end of the shaft 3 and the drive force from a drive source M is input by a gear 6 through a gear train or a chain (not shown). The drive force is transmitted to the shaft 3 by opening-closing of the electromagnetic clutch 5 or makes the shaft 3 free.

Figure 2A:
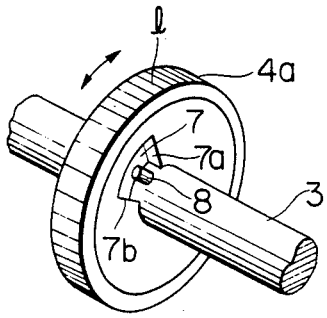
FIGS. 2A and 2B are perspective views showing the construction of paper feed rollers.
Figure 2B:
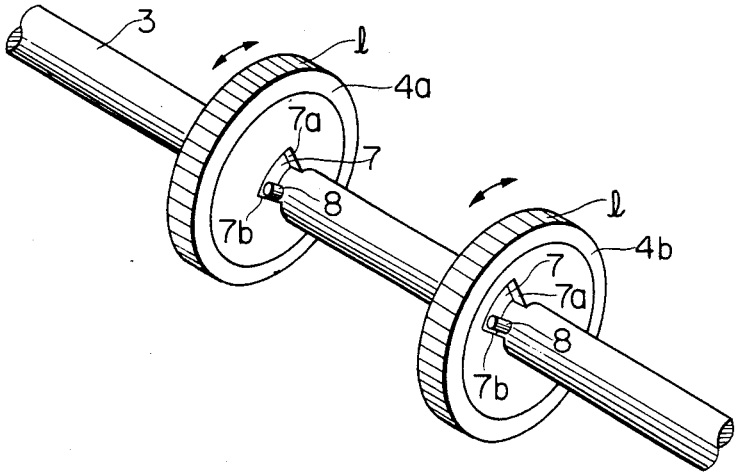

As previously described, the paper feed rollers 4*a*, 4*b* and 4*c* are rotatably mounted on the shaft 3 and have a constructional relation with the shaft 3 as shown in FIGS. 2A and 2B. That is, a recess 7 preferably of a sector shape is formed in the radially inner portion of the paper feed roller 4*a* and a pin 8 fixed to the shaft 3 is positioned in the recess 7. Thus, in the present embodiment, the roller 4*a* is rotatable relative to the shaft 3 in a forward direction or a reverse direction within a range in which the pin bears against the inner ends 7*a* and 7*b* of the recess 7. FIG. 2B shows a condition in which the rollers 4*a* and 4*b* have been rotated in the forward direction relative to the shaft 3 and the inner end 7*b* of the recess 7 bears against the pin 8. Accordingly, the rollers 4*a* and 4*b* are restrained by the pin 8 against any further rotation in the forward direction relative to the shaft 3. Although not shown, collars or other suitable thrust stop means secured to the shaft 3 are disposed on the opposite side surfaces of the feed roller 4*a* to establish the axial position of the paper feed roller relative to the shaft 3.

Although FIGS. 2A and 2B show the paper feed roller 4*a* or 4*b*, the constructional relation of the other paper feed roller 4*c* with the shaft 3 is entirely similar to that of the roller 4*a*.

Description will now be made of a case where the cassette 1 is pulled out in the above-described construction. When a sheet fed out of the cassette 1 by rotation of the paper feed rollers 4*a*, 4*b* and 4*c* arrives at register rollers (not shown), a signal is produced by a sequence, not shown, to open the electromagnetic clutch 5 and bring about a condition in which the drive force is not exerted on the shaft 3. Consequently, when the cassette 1 is mounted or dismounted, the drive force is not exerted on the shaft 3. Thus, the cassette 1 is moved in the direction of arrow B. At this time, the shaft 3 and accordingly the paper feed rollers 4*a*, 4*b* and 4*c* mounted thereon are freely and lightly rotatable in any direction (forward or reverse direction) and therefore, the cassette can be pulled out without disturbing the sheets therein even if each paper feed roller bears against the sheets in the cassette.

Figure 3:
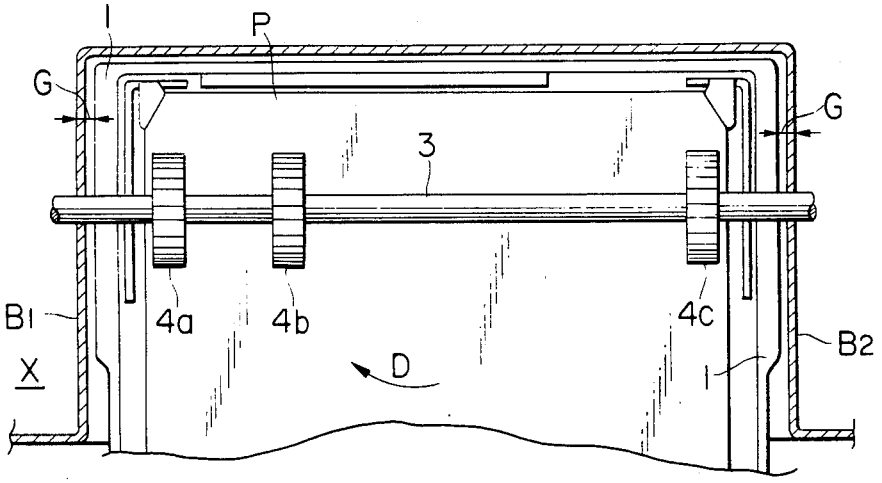
FIG. 3 is a plan view sowing the constructional relation among a cassette, sheets contained in the cassette and paper feed rollers.

During this pulling-out operation, as shown in FIG. 3, there is usually some gap as indicated by G between the side plate members B1, B2 of the cassette containing portion of the body X and the opposite side surfaces of the cassette 1 and therefore, it is very difficult to perfectly pull out the cassette 1 in the direction of arrow B indicated in FIG. 1. Therefore, usually, although slight, the tendency to rotate in the direction indicated by arrow D in FIG. 3 (or in the direction opposite thereto) occurs unavoidably.

If such tendency to rotate occurs, the uppermost sheet in the cassette creates a sheet-twisting action between it and the paper feed rollers and the sheets may be disturbed by the twist even if the sheets are sufficiently lightly movable in the direction of arrow B.

In contrast, in the present embodiment, the paper feed rollers are designed to be slightly rotatable relative to the shaft 3 and therefore, the inconvenience as noted above can be eliminated.

This will be described by reference particularly to FIGS. 2 and 4.

In the present embodiment, as previously described, the paper feed roller 4*a* (as well as the other paper feed roller) is rotatable relative to the shaft 3 and the pin 8 secured to the shaft 3 is contained in the recess 7 formed in the roller and therefore, within the range of the recess 7, the paper feed roller 4*a* is freely rotatable in any of the forward and reverse directions relative to the shaft 3.

Figure 4:
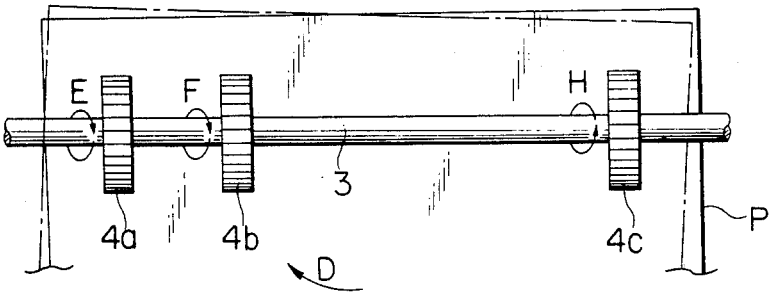
FIG. 4 illustrates relationship of the paper feed rollers and sheets when the cassette is shifted.

If, as shown in FIG. 4, the tendency to rotate in the direction of arrow D occurs to the cassette 1 when it is pulled out, the tendency to rotate in the direction of the broken line from the position indicated by the solid line in FIG. 4 also occurs to the sheets P in the cassette and along therewith, torques as indicated by letters E, F and H in FIG. 4 are exerted on the respective paper feed rollers 4*a*, 4*c* and 4*c* which bear against the sheets.

On the other hand, as previously described, the paper feed rollers are rotatable in any direction relative to the shaft 3 within a predetermined range and therefore, along with the aforementioned torques, the paper feed rollers are rotated in accordance with the deflection of the sheets and thus, do not disturb or damage the sheets.

When the cassette and accordingly the sheets are deflected in the direction opposite to the direction of arrow D, the cassette can just likewise be pulled out easily without disturbing the sheets.

When the cassette 1 is to be mounted on the apparatus body X, the magnetic clutch 5 is opened to maintain the shaft 3 free, whereby even if the sheets in the cassette 1 to be inserted bear against the paper feed rollers and even if, during the insertion of the cassette 1, the direction of movement of the cassette is not exactly orthogonal to the shaft 3, the shaft 3 and the paper feed rollers rotate lightly and the paper feed rollers are freely rotatable relative to the shaft 3, whereby the cassette 1 can be easily set at a predetermined position in the apparatus X without disturbing or damaging the sheets.

Figure 5:
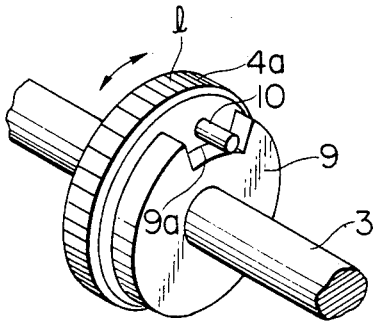
FIG. 5 is a perspective view showing another example of the construction of the paper feed roller.

FIG. 5 shows another embodiment of the construction for rotatably mounting the paper feed rollers. A pin 10 is secured to one side surface of the paper feed roller 4*a* (as well as the other rollers) rotatably disposed on the shaft 3, and this pin 10 is designed to be positioned in a recess 9*a* formed in a collar 9 secured to the shaft 3. Accordingly, it will be apparent that within the range of the recess 9*a*, the paper feed roller is freely rotatable relative to the shaft 3. Of course, the roller 4*a* is provided with suitable thrust stop means as in FIG. 2.

Figure 6:
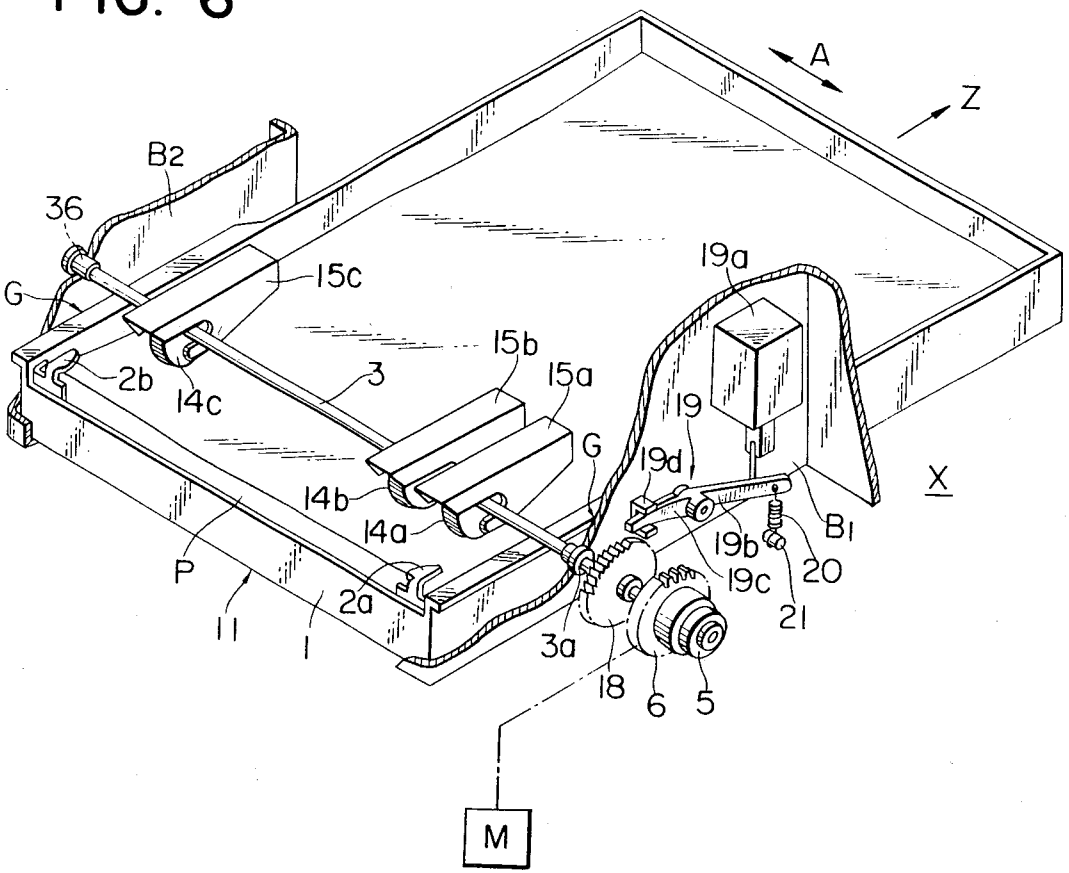
FIG. 6 is a perspective view showing the relation between a sheet feeding device to which an embodiment of the present invention is applied and a cassette.

Still another embodiment is shown in FIG. 6. In FIG. 6, members similar to those of the previously described embodiment are given similar reference numerals.

When the cassette 1 is at its set position shown in FIG. 6, a suitable number (three in the shown embodiment) of circular paper feed rollers 14*a*, 14*b* and 14*c* disposed on a drive shaft 3 disposed on the image forming apparatus X side are adapted to be urged against the uppermost one of sheets biased toward the upper open portion of the cassette 1 as previously described.

A ratchet wheel 18 is secured to the shaft 3, and a brake mechanism provided with a solenoid 9*a* and a pawl piece 19*c* engageable with the ratchet wheel 18 by the solenoid is despised on the image forming apparatus X side, as will hereinafter be described.

All of the paper feed rollers 14*a*, 14*b* and 14*c* mounted on the drive shaft 3 are of similar construction and therefore, the construction of one of the paper feed rollers, 14*a*, will hereinafter be described by reference to FIGS. 8A and 8B. As shown, a roller body 14*a*′ provided with a rubber ring 14*a*″ for frictionally dragging the sheets is mounted on the drive shaft 3 for rotation with the shaft 3, and a pin 13*a* secured to the shaft 3 is engaged in slits S and S formed in the roller body 14*a*′ and a slight clearance F is formed between a bore in the roller body 14*a*′ through which the shaft 3 extends. Further, thrust stop collars 23 and 24 are secured to the opposite sides of the roller body 14*a*′ with some clearance left with respect to the opposite sides of the roller body. Since all of the rollers 14*a*, 14*b* and 14*c* are of the above-described construction, they can be displaced in the thrust direction on the shaft 3 within the range of the spacing between the collars, and the pin 13*a* is movable in the slit S and thus, it is rockably mounted conjointly with the presence of the clearance F.

Figure 9:
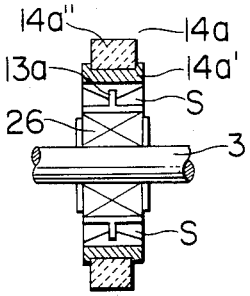
FIG. 9 is a cross-sectional view showing another example of the construction of the paper feed roller.

FIG. 9 shows another example of the construction of the paper feed roller secured to the shaft 3. The construction in which a ring 14*a*″ for frictionally dragging the sheets, a roller body 14*a*′ supporting the ring 14*a*″ and a pin 13*a* secured to the shaft 3 are loosely fitted in a slit S is similar to the roller shown in FIGS. 3A and 3B, with the exception that there is provided a one-way clutch 26 adapted to be locked during the rotation of the shaft 3 in the driving direction.

Figure 7:
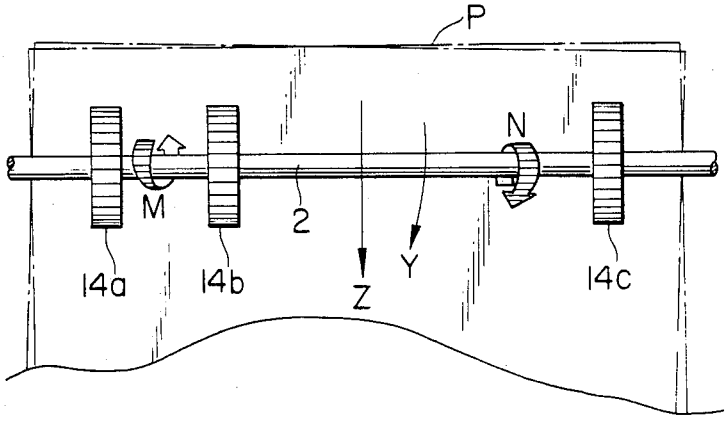
FIG. 7 is a plan view showing the relation between a sheet in the cassette and the paper feed rollers.

FIGS. 6 and 7 are a perspective view and a plan view, respectively, showing the relation between the sheet and the paper feed rollers in a case where the cassette 1 is disposed at a predetermined position in the image forming apparatus. Description will first be made of a case where the cassette 1 placed at the predetermined position is pulled out. In FIG. 6, when the cassette 1 is displaced in the direction of arrow Z, the electromagnetic clutch 5 is opened to render the shaft 3 rotatable, whereby the shaft 3 can be rotated at a low torque and therefore, the cassette 1 can be easily pulled out even if the rollers are in contact with the sheet. Usually, there is some gap G (FIG. 6) to enable the cassette 1 in the image forming apparatus X to be readily mounted or dismounted between the side walls B1 and B2 of the apparatus X. Therefore, the cassette 1 cannot always be pulled out exactly in the direction of arrow Z, but rather it is usually deflected to a certain degree. This is shown in FIG. 7. If the cassette 1 is pulled out while being deflected, for example, in the direction of arrow Y as viewed in FIG. 7, the rollers 14*a* and 14*b* rotate or pivot by a suitable amount in the direction of arrow M and the roller 14*c* rotates or pivots by a suitable amount in the direction of arrow N, in accordance with the deflection in the direction of arrow Y of the cassette and accordingly of the sheet against which the paper feed rollers bear, because the paper feed rollers 14*a*, 14*b* and 14*c* as shown in FIGS. 8A and 8B are somewhat pivotable at each position and axially displaceable as previously described, and thus the cassette can be pulled out of the image forming apparatus without disturbing the position of the sheets in the cassette and without wrinkling the sheets.

Also, when the cassette and sheets are deflected and removed in the direction Y, where the paper feed rollers as shown in FIG. 9 are employed, the sheets tend to be deflected in the original direction of movement (the direction of arrow M) relative to the paper feed rollers 14*a* and 14*b* and deflected in the opposite direction (the direction of arrow N) relative to the paper feed roller 14*c* and therefore, the rollers 14*a* and 14*b* are rotated by the one-way clutch 26 locked in the direction of movement and the roller 14*c* follows the movement of the sheets in the direction of pull-out with the direction of free rotation of the clutch 26 and after all, the cassette can be pulled out without disturbing the position of the sheets in the cassette.

Figure 8A:
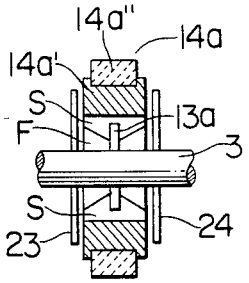
FIGS. 8A and 8B are a cross-sectional view and a side view, respectively, of the paper feed roller.
Figure 8B:
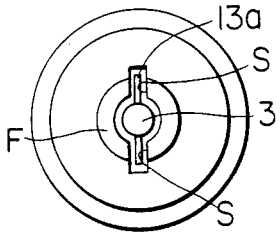

It will readily be seen that where the direction of removal of the cassette 1 is opposite to the direction Y, even if any of the paper feed rollers shown in FIGS. 8A and 8B or FIG. 9 is employed, the pulling-out operation can just likewise be accomplished without imposing any burden on the sheets.

Also, when the cassette 1 is to be mounted on the image forming apparatus from outside, it cannot be expected due to the presence of the gap G between the cassette 1 and the side walls of the apparatus that the cassette 1 is inserted in a proper direction, but if the cassette 1 is inserted with the shaft 3 separated from the driving portion, the paper feed rollers pivot or rotate in response to the movement of the sheets in the widthwise direction thereof in just the same manner as that in the case of the aforementioned pulling-out operation. Thus, even if the forward end of the sheets bear against the paper feed rollers during the inserting operation, the sheets are not forcibly displaced in the cassette, and then even during the time that the paper feed rollers come to their predetermined positions in the apparatus while being urged against the sheets, the paper feed rollers follow the sheets half-fixed by a push-up spring and separating pawls 2a, 2b in the cassette, within the range of free displacement of the paper feed rollers relative to the shaft 3 and therefore, the sheets are mounted at a predetermined position in the image forming apparatus without the position thereof being disturbed.

Figure 10:
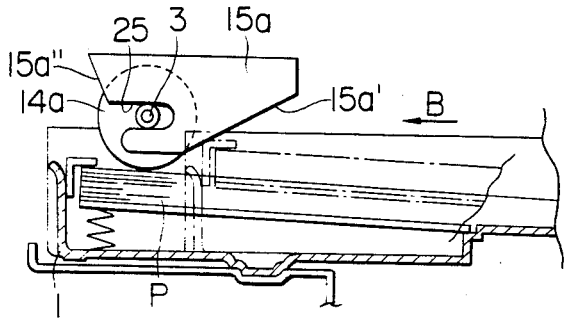
FIG. 10 is a side cross-sectional view showing a cassette as inserted into its set position.

Saying in addition, the deflectedly moved cassette and accordingly the sheets have a portion locally displaced in the original direction of movement near the paper feed rollers and a portion displaced in the direction opposite thereto and therefore, the paper feed rollers are disposed so as to lie on the opposite sides of the center line of the direction of movement of the sheets.

as shown in FIGS. 6 and 10, guide members 15a, 15b and 15c formed substantially in a trapezoidal shape as viewed from a side thereof and having a U-shaped cross-section are disposed on the paper feed rollers 14a, 14b and 14c , respectively. The top surface of each of these guide members is fixed to an unshown proper portion of the image forming apparatus, the shaft 3 lies in a slit 25 formed in each guide member and the paper feed roller 14a is disposed so as to be sandwiched between the opposite depending portions of the guide member 15a.

Further, the foward and rearward edges of the guide member 15a as viewed in the direction of movement of the sheets are formed into tapered surfaces as shown at 15a' and 15a'' in FIG. 10.

The aforementioned brake mechanism will now be described. As can be seen from the foregoing description, as regards the drive the shaft 3, the change-over thereof with respect to an input gear 17 to which a drive force is normally input is effected by the electromagnetic clutch 5 and therefore, even if the clutch 5 is deenergized during paper feeding operation, there is some time lag before the shaft 3 is stopped. Therefore, it is desirable that design be made such that particularly when the paper feed speed is high, the shaft 3 is positively stopped for the deenergization of the electromagnetic clutch 5 to thereby prevent any fluctuation of the amount of feed of a sheet. The brake mechanism now under discussion is directed to such a purpose.

The brake mechanism, as shown in FIG. 6, is provided with a ratchet wheel 18 fixed to the shaft 3 and a pawl 19c engageable therewith by a solenoid 19a, and the construction thereof will hereinafter be described by reference to FIGS. 11A and 11B.

The pawl 19c engageable with the ratchet wheel 18 and an arm 19b for operating the pawl are pivotally mounted on a pin 22 secured to a suitable portion of the image forming apparatus. One end of a spring 20 having the other end thereof secured to a pin 21 provided on the apparatus side is secured to one of the free ends of the arm 19b, the other end of the arm 19b is formed into a U-shaped portion 19d, and the pawl 19c is positioned in the U-shaped portion 19d and biased against one leg of the U-shaped portion by a spring 19e. The movable core of the solenoid 19a secured to the image forming apparatus side is pivotally connected to a portion of the arm 19b.

Figure 11A:
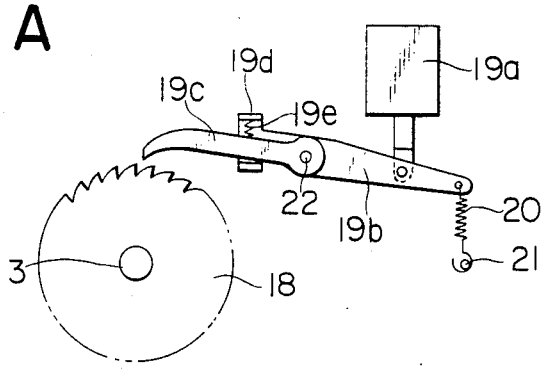
FIGS. 11A and 11B are a side view and an exploded perspective view, respectively, of a brake mechanism.
Figure 11B:
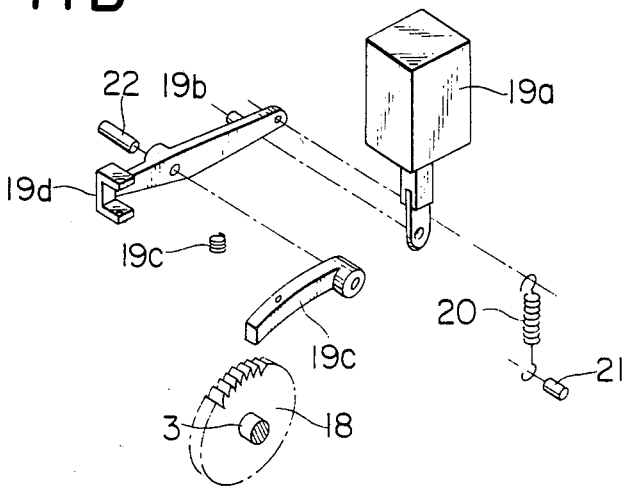

With the above-described construction, when the solenoid 19a is deenergized, the arm 19b tends to be pivotally moved in clockwise direction as viewed in FIG. 11A by the action of the spring 20 and the pawl 19c is caused to bear against the lower end of the U-shaped portion 19d of the arm 19b by the spring 19e, and the arm 19b and the pawl 19c are in their positions as shown in FIG. 11A wherein they are not engaged with the ratchet wheel 18. When the solenoid 19a is energized, the arm 19b pivots counter-clockwisely against the force of the spring 20 and along therewith, the pawl 19c also pivots in the U-shaped portion 19d under the action of the spring 19e and comes into engagement with the ratchet wheel 18, thereby stopping the shaft 3.

The paper feeding device according to the present embodiment is generally of the above-described construction. Description will now be made of a case where the cassette 1 is pulled out of the position as shown, for example, in FIG. 6 wherein it is set in the image forming apparatus X. During the inoperative condition of the apparatus, the electromagnetic clutch 5 is deenergized and the drive source M and the shaft 3 are disconnected, so that the shaft 3 becomes rotatable in itself and the cassette 1 can be easily drawn out by being pulled out in the direction in which it is set. Also, in this case, a slight gap G(see FIG. 6) is usually present between the opposite side surfaces of the cassette and the side plates B1, B2 of the image forming apparatus which control the set position and therefore, it is virtually impossible to pull the cassette straight out and usually, the cassette is deflected in any of the directions indicated by double-beaded arrow A in FIG. 6. In the present embodiment, however, the paper feed rollers 15a, 15b and 15c pivotally mounted on the shaft 3 are of the construction as shown in FIGS. 8A and 8B and are somewhat displaceable axially of the shaft 3 and, as is apparent from the constructional relation between the pin 13a and the slit S, they are also pivotable and therefore, the paper feed rollers can freely follow the deflection of the cassette and accordingly the sheets P contained therein in the directions of arrow A, so that coupled with smooth rotation of the roller 15a integral with the shaft 3, the sheets are not disturbed or wrinkled or damaged during the cassette pulling-out operation.

Description will now be made of a case where the cassette 1 is inserted and set in the image forming apparatus X, by reference to FIG. 10. In FIG. 10, when the cassette 1 is inserted in the direction of arrow B, the level of the uppermost sheet is constant irrespective of the quantity of the sheets and therefore, the forward end thereof does not directly bear against the paper feed rollers but bears against the tapered surface 15a' of the guide member 15a and the cassette 1 moves forward while urging the sheets downwardly against the force of the spring in the cassette. Accordingly, by suitably determining the angle of the tapered surface 15a' and making design such that the tapered surface bears against the sheets P in the cassette 1 as smoothly as possible, and further due to the fact that the paper feed rollers are displaceably and pivotably supported on the shaft 3 as previously described, the sheet which has been urged downwardly by the tapered surface 15a' and arrived at the position of the paper feed rollers enables the cassette to be mounted by being only moved to the set position within the apparatus in a plane.

As described above in detail, according to the present embodiment, the mounting or dismounting of the cassette with respect to the image forming apparatus can be accomplished by only moving it in a plane without disturbing or damaging the sheets in the cassette and therefore, no excess space is required in the apparatus, and this enhances the operability of the cassette.

Also, by installing the brake mechanism as previously described, the paper feeding device can stably operate even in the case of high-speed paper feeding, and this greatly contributes to the reliability of paper feeding.

Further, by providing the paper feed guide with a tapered surface as previously described, even when less rigid sheets are used or when the sheets have become soft by absorbing moisture, the sheets are not disturbed during the mounting of the cassette. Also, by disposing the tapered surface 15*a*″ forwardly of the guide member 15*a* so as to be superposed on the outer periphery of the paper feed rollers, it is possible to prevent the sheet taken out by the paper feed rollers from winding round these rollers to cause jam.

Still another embodiment of the present invention will hereinafter be described by reference to FIGS. 12 to 20.

Figure 12:
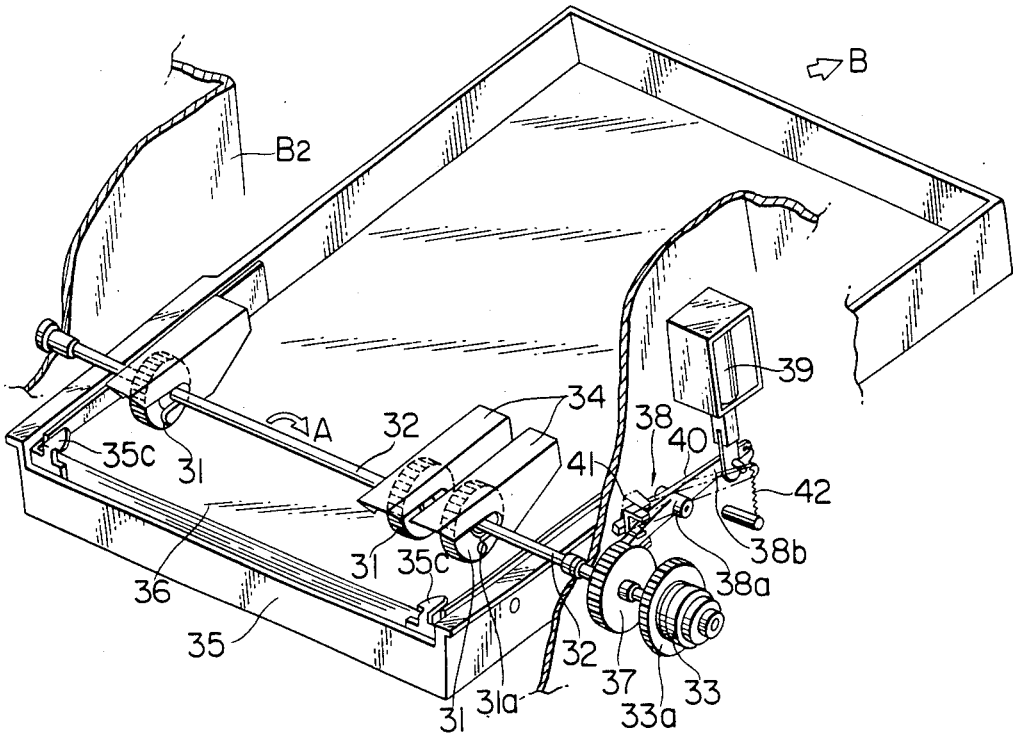
FIG. 12 is a perspective view of an embodiment of the present invention.
Figure 13:
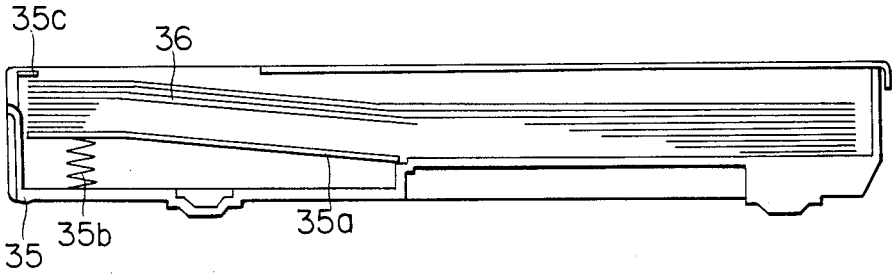
FIG. 13 is a cross-sectional view of the cassette.

FIG. 12 is a perspective view of an embodiment of the present invention. In FIG. 12, each of feed rollers 31 has a one-way clutch 31*a* attached thereto The one-way clutch is mounted in a direction in which it is locked when a feed shaft 32 is rotated in the direction of arrow A (the direction opposite to the direction for feeding sheets). An electromagnetic clutch 33 for driving the feed shaft is mounted on the feed shaft 32, and the power for driving it is input to a clutch gear 33*a*. A paper entry guide 34 attached to the apparatus body X is disposed above each feed roller 31, and a cassette 35 containing sheets 36 therein is disposed below the feed rollers 31. A latch disc 37 for stopping rotation of the feed shaft 32 is mounted on the feed shaft 32. The latch disc 37 controls rotation of the feed shaft 32 by a latch 38. The latch 38 is driven by a plunger 39 engaged therewith, and the latch 38 and the latch disc 37 are normally spaced apart from each other. FIG. 13 is a cross-sectional view of the cassette 35 of FIG. 12. In FIG. 13, sheets 36 are placed on a pivotable support tray 35*a* in the cassette 35, the support tray 35*a* being resiliently supported by a spring 35*b*.

In the above-described construction, a case where the cassette 35 is pulled out of the apparatus body (not shown) will first be described.

When the cassette 35 is to be pulled out, the cassette 35 is moved in the direction of arrow B indicated in FIG. 12. The direction of arrow B is the locking direction of the one-way clutch 31*a* of each feed roller 31 and therefore, the feed shaft 32 must move very lightly in order that the cassette 35 may be pulled out without disturbing the sheets 36.

Now, when the cassette 35 is pulled out, that is, when feeding operation is not effected, the electromagnetic clutch 33 is deenergized in response to a signal and the latch disc 37 and the latch 38 are spaced apart from each other (the operation of the latch disc 37 and the latch 38 will later be described). Accordingly, no force is exerted on the feed shaft 32 and thus, the feed shaft rotates lightly, the direction of rotation of the feed shaft being free. Therefore, by the feed shaft 32 rotating, the cassette 35 can be pulled out without disturbing the sheets 36 even if the rollers 31 are in contact with the sheet 36.

Figure 14:
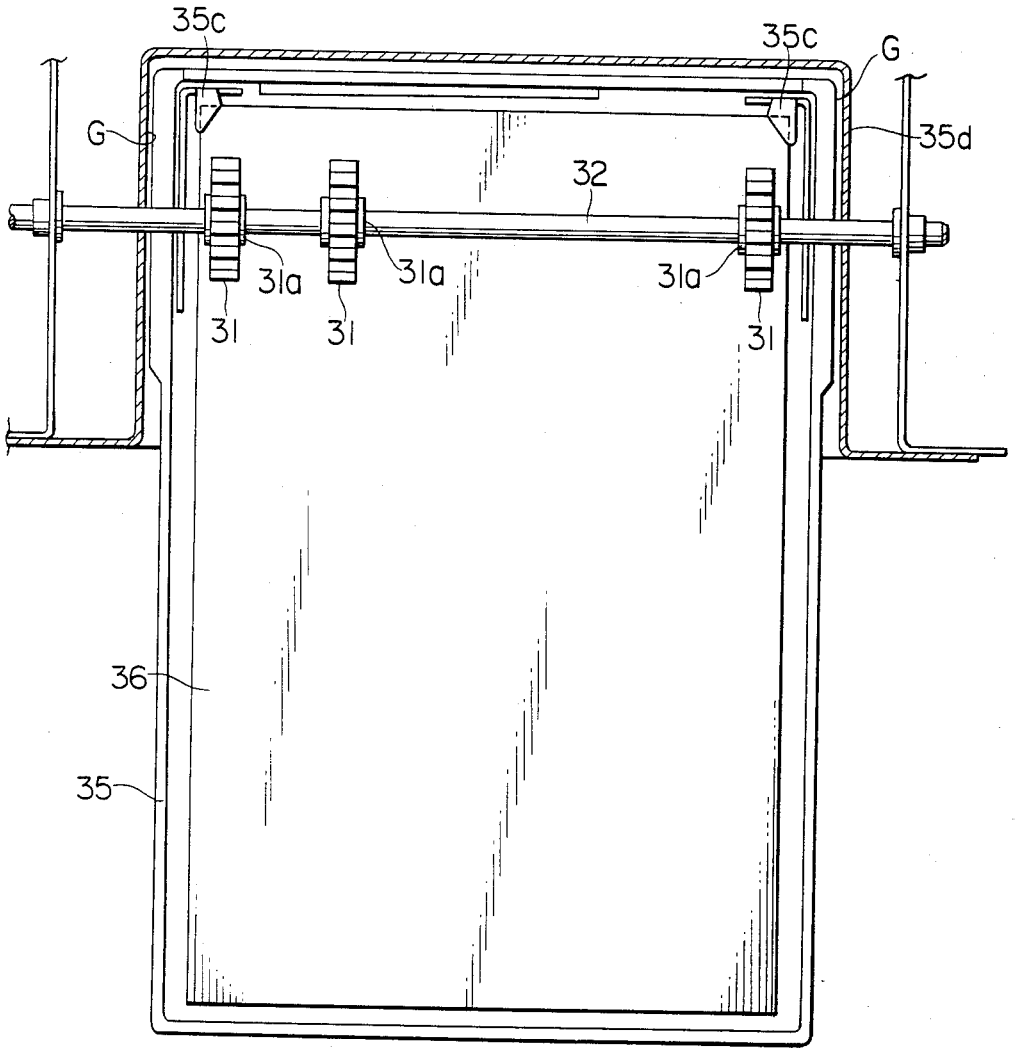
FIGS. 14 and 15 are top plan views of the embodiment of FIG. 12.
Figure 15:
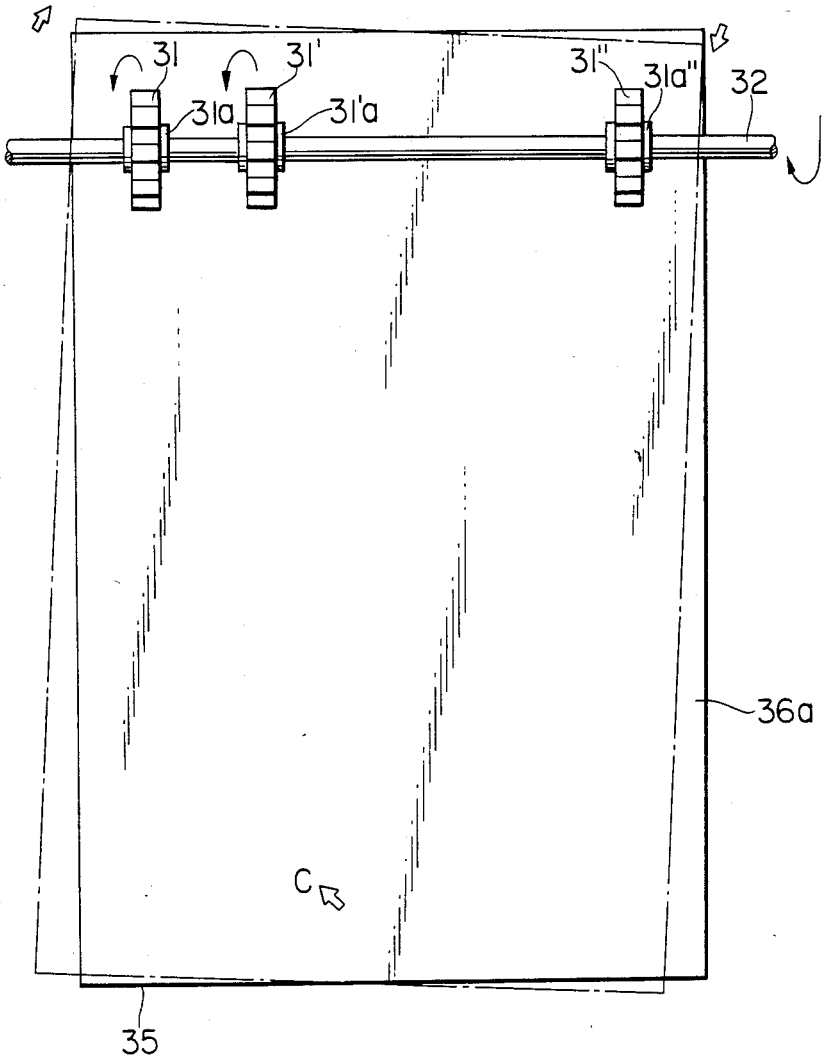

In use, however, the cassette 35 is not always pulled straight out in the direction of arrow B and, as shown in FIG. 14, there is a gap G between the receiving portions 35*d* for the cassette 35 and the cassette 35 and leftward or rightward movement of the cassette 35 is not perfectly controlled. Therefore, in some cases, the cassette 35 may be pulled out slightly obliquely or while being deflected to the left or the right. Such a case is shown in FIG. 15. FIG. 15 is a top plan view of the uppermost sheet 36, feed rollers 31, 31′, 31″, one-way clutches 31*a*, 31′*a*, 31″*a* and feed shaft 32. Assuming that the cassette 35 (not shown) has been deflected in the direction of arrow C indicated in FIG. 15, the sheet 36*a* is displaced from the position indicated by solid lines to the position indicated by dot-and-dash lines. At this time, the one-way clutches 31*a* and 31′*a* of the feed rollers 31 and 31′ are in the direction of free rotation while the one-way clutch 31″*a* of the feed roller 31″ is in the locking direction. Therefore, by the movement of the sheet 36*a*, the feed roller 31″ is rotated with the feed shaft 32 and the feed rollers 31 and 31′ are rotated in the direction of free rotation of the one-way clutches 31*a* and 31′*a*. Accordingly, little or no load is exerted on the sheet 36*a* and the sheet 36*a* can move with the movement of the cassette 35 without being disturbed. It is apparent that this also holds true when the cassette has been deflected in the direction opposite to the direction of arrow.

Thus, the sheets 36 supported in the cassette 35 are not disturbed even if the cassette 35 is pulled out obliquely or leftwardly or rightwardly.

Description will now be made of a case where the cassette is loaded into the apparatus.

Figure 16:
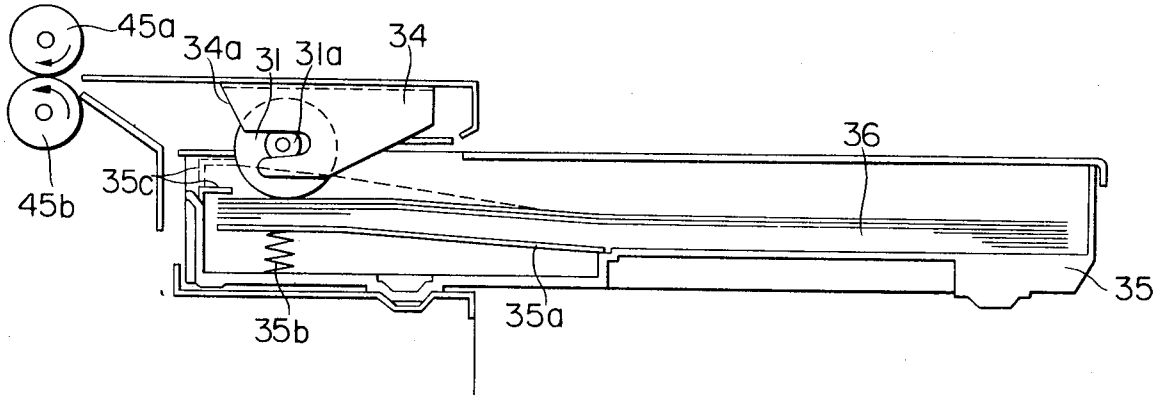
FIG. 16 is a longitudinal cross-sectional view of the embodiment of FIG. 12.
Figure 18:
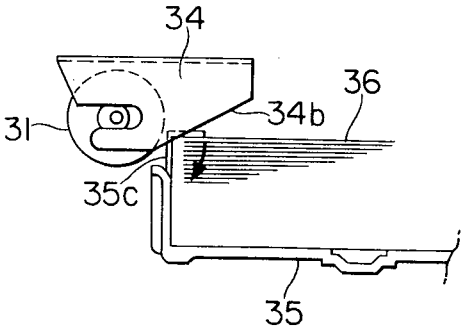
FIG. 18 shows the upper limit of a separating pawl in the cassette of an embodiment of the present invention.
Figure 17:
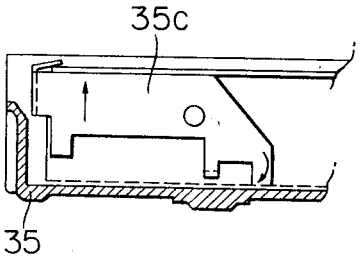
FIG. 17 is a cross-sectional view showing the movement of the cassette of an embodiment of the present invention when inserted.

In FIG. 16, the position of the sheets 36 before the cassette 35 is loaded into the apparatus is indicated by broken line and the position of the sheets 36 after the cassette 35 has been loaded into the apparatus is indicated by solid lines. In FIG. 16, reference numerals 45*a* and 45*b* designate register rollers which convey the sheet fed out of the cassette 35 by the rollers 31, 31′ and 31″, in synchronism with the image on a drum (not shown). With the cassette 35 not yet loaded into the apparatus, the sheets 36 are pushed up by the spring 35*b* and the forward end of the sheets lies at the position of the aforementioned broken line. This position is controlled by the separating pawl 35*c* in the cassette 35, as shown in FIG. 17 and 18. Also, as shown in FIG. 16, the forward end portion 34*a* of the paper entry guide 34 is inclined rearwardly to thereby prevent winding of jammed sheets. When the cassette 35 is to be loaded into the apparatus in this condition, as shown in FIG. 18, the sheets 36 are depressed by the inclined lower end portion 34*b* of the paper entry guide 34 above the feed rollers 31 before the forward end of the sheets 36 comes into contact with the feed rollers 31. Thus, the sheets 36 come into contact with the feed rollers 31 at their so sufficiently depressed position and therefore, the feed rollers 31 are rotated by the one-way clutches 31*a* without damaging the fore end of the sheets 36. Also, as is apparent from FIG. 16, with the cassette 35 loaded into the apparatus, the paper entry guide 34 is positioned sufficiently above the lower surface of the feed rollers 31 and thus does interfere with the sheets 36 when paper feeding is effected. Even if the cassette 35 is loaded into the apparatus slightly obliquely or while being deflected to the left or the right, the sheets 36 in the cassette 35 are not disturbed as in the case where the cassette 35 is pulled out.

However, it can be readily considered that where the leftward and rightward movement of the cassette 35 is very small, there will be no particular hindrance to the mounting or dismounting of the cassette even if there is provided no one-way clutch.

Description will now be made of a brake mechanism shown in FIG. 12 which comprises a latch disc 37, latches 38*a*, 38*b* and a plunger 39.

The driving of the feed rollers 31 (feed shaft 32) is controlled by ON-OFF of the electromagnetic clutch 33 and therefore, the opening time of the electromagnetic clutch 33 (the time from after the power source of the electromagnetic clutch is switched off until the feed shaft is stopped) is fluctuated by the fluctuation of the load of the feed rollers 31 and the inertia of the feed rollers 31 and the feed shaft 32 The fluctuation of this opening time provides a fluctuation of the amount of feed of a sheet and therefore, it is desirable that such fluctuation be made as small as possible in a machine of great paper feed speed. For this purpose, the electromagnetic clutch can be stopped by a brake device capable of always applying a load at predetermined timing.

Figure 19:
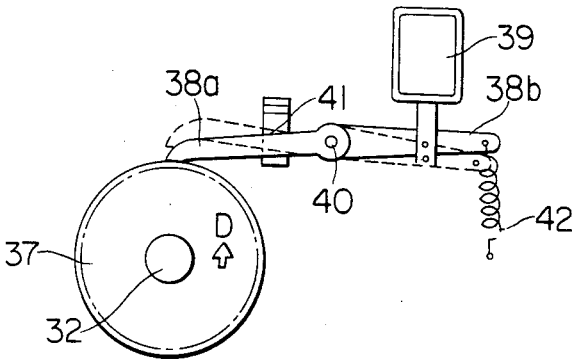
FIGS. 19 and 20 are detailed illustrations of the brake device of an embodiment of the present invention.
Figure 20:
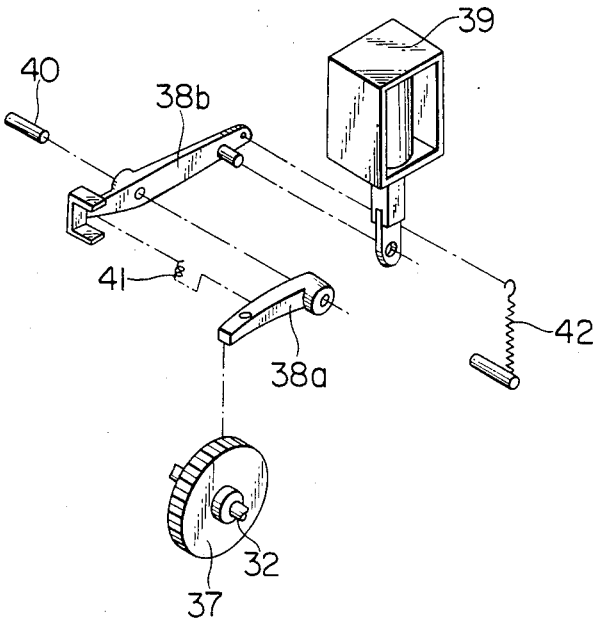

The details of the brake device in the present embodiment are shown in FIGS. 19 and 20. The latch disc 37 is fixed to the feed shaft 32. The latch comprises a pawl portion 38*a* and an arm portion 38*b* for vertically moving the pawl portion 38*a*. The pawl portion 38*a* and the arm portion 38*b* are pivotably mounted on a shaft 40. When in mesh engagement with the latch disc 37, the pawl portion 38*a* is held down by a spring 41 provided in the U-shaped portion of the arm portion 38*b*. When the pawl portion is separated from the latch disc, the arm portion 38*b* is pulled downwardly by a spring 42 and the pawl portion 38*a* is raised by the lower end of the U-shaped portion of the arm portion 38*b*. The arm portion 38*b* of the latch may be driven vertically by a plunger 39, but normally the arm portion 38*b* is pulled downwardly by the spring 42 and accordingly, the pawl portion 38*a* is spaced apart from the latch disc 37.

As soon as the power source of the electromagnetic clutch 33 is switched off, the plunger 39 is attracted to bring the pawl portion 38*a* into mesh engagement with the latch disc 37 and apply a brake, thereby stopping rotation of the feed shaft 32. After the rotation of the feed shaft 32 has been stopped, the plunger 39 is deenergized and the arm portion 38*b* is pulled by the spring 42, whereby the pawl portion 38*a* is raised out of engagement with the latch disc 37.

The time during which the pawl portion 38*a* is in mesh engagement with the latch disc 37 is very short, but even if the cassette 35 is pulled out during this time, the latch pawl portion 38*a* is only pushed down by the spring 41 and the latch disc 37 is rotatable in the direction of arrow D (the direction in which the cassette is pulled out) and therefore, the latch is not damaged or the sheets 36 in the cassette are not disturbed.

In the previously described embodiment, the brake device applies a load to the feed shaft 32 at predetermined timing and thus, it may be an electromagnetic brake.

In the present embodiment, it is also possible to mount the latch disc 37 on the feed shaft 32 through a one-way clutch which is in the same direction as the feed rollers 31, and to make the latch pawl portion 38*a* and the arm portion 38*b* integral with each other.

Further, in a machine of low feeding speed, the fluctuation of the amount of feed of a sheet resulting from the fluctuation of the opening time of the electromagnetic clutch is small and therefore the brake device need not always be provided.

Furthermore, where the diameter of the feed rollers is great and the amount of push-in of sheets is small, there will be no particular hindrance even if there is provided no paper entry guide, but where sheets having absorbed moisture or deformed are used, the reliability of the mounting or dismounting of the cassette can be enhanced by a paper entry guide.

Also, as described above, according to the present embodiment, in a feeding device comprising circular feed rollers and a paper supply cassette, the paper supply cassette can be entirely freely mounted or dismounted with the feed shaft remaining fixed and thus, the operability of handling the cassette can be enhanced. This does not lead to increased dimensions of the machine.

As described above, the present invention provides a sheet feeding device which can stably feed sheets and can be easily mounted and dismounted.

What we claim:

1. A sheet feeding apparatus comprising:

sheet supporting means for supporting at a determined position a set of sheets inserted in a predetermined direction;

a plurality of feed rollers for feeding one by one in said predetermined direction the sheets supported at said determined position;

a drive shaft for supporting said feed rollers at a position where the feed rollers contact the uppermost sheet when the set of sheets are inserted into said determined position to be supported thereat by said sheet supporting means; and connecting -disconnecting means for disconnectably connecting said drive shaft to a drive source;

wherein said respective feed rollers are supported on said drive shaft such that the feed rollers may independently freely rotate by a predetermined amount, respectively both in said predetermined direction and in a reverse direction thereto when the feed rollers contact the uppermost sheet upon the insertion of the sheet set, whereby when a set of sheets is moved, upon insertion into the apparatus, the feed rollers follow the movement of the sheets, thus eliminating the possibility of friction between the uppermost sheet of the set of sheets and the feed rollers and therefore preventing sheet deviation to prevent creasing, wrinkling or tearing of the sheet.

2. A sheet feeding device according to claim 1, wherein said rollers may freely shift by a predetermined amount in the axial direction with respect to said drive shaft on an independent basis.

3. A sheet feeding device according to claim 1, wherein said rollers may freely obliquely rock in a thrust direction with respect to said drive shaft on an independent basis.

4. A sheet feeding device according to claim 1, wherein said drive shaft is provided with at least one pin fixed to the shaft and engaging in an associated slot or slots formed in a radial inner portion of the rollers.

5. A sheet feeding device according to claim 1, wherein a pin fixed at the side face of the roller engages in a recess formed in a collar which is secured on the drive shaft.

6. A sheet feeding device according to claim 2, wherein the axial displacement of the rollers is limited by collars fixed on the drive shaft.

7. A sheet feeding device according to claim 3, wherein a radial gap is provided between the roller and the drive shaft to permit said limited oblique positioning.

8. A sheet feeding apparatus comprising:

sheet supporting means for supporting at a determined position a set of sheets inserted in a predetermined direction;

a plurality of feed rollers for feeding one by one in said predetermined direction the sheets supported at said determined position;

a drive shaft for supporting said feed rollers at a position where the feed rollers contact the uppermost sheet when the set of sheets are inserted into said determined position to be supported thereat by said sheet supporting means; and connecting-disconnecting means for disconnectably connecting said drive shaft to a drive source;

wherein said respective feed rollers are supported on said drive shaft such that the feed rollers may independently freely rotate by a predetermined amount, respectively both in said predetermined direction and in a reverse direction thereto when the feed rollers contact the uppermost sheet upon the insertion of the sheet set;

and further said feed rollers are axially rockably supported independently on said drive shaft, respectively.

9. A sheet feeding device according to claim 8, wherein said drive shaft is provided with at least one pin fixed to the shaft and engaging in an associated slot or slots formed in a radial inner portion of the rollers.

10. A sheet feeding device according to claim 8, wherein a pin fixed at the side face of the roller engages in a recess formed in a collar which is secured on the drive shaft.

11. A sheet feeding device according to claim 8, wherein the axial displacement of the rollers is limited by dollars fixed on the drive shaft.

12. A sheet feeding device according to claim 8, wherein the limited oblique positioning is warranted by a radial gap between the roller and the drive shaft.

* * * * *

UNITED STATES PATENT AND TRADEMARK OFFICE

CERTIFICATE OF CORRECTION

PATENT NO. : 4,799,662

DATED : January 24, 1989

INVENTOR(S) : SEIJI SAGARA, ET AL.

It is certified that error appears in the above-identified patent and that said Letters Patent is hereby corrected as shown below:

Column 2, line 42, "sowing" should read --showing--.

Column 4, line 64, "4c" (first occurrence) should read --4b--.

Column 5, line 41, "despised" should read --disposed--.

Column 7, line 20, "as" should read --Also, as--.

Column 14, line 5, after "tively" the following should be inserted:

--, whereby when a set of sheets is moved, upon insertion into the apparatus, the feed rollers follow the movement of the sheets, thus eliminating the possibility of friction between the uppermost sheet of the set of sheets and the

UNITED STATES PATENT AND TRADEMARK OFFICE

CERTIFICATE OF CORRECTION

PATENT NO. : 4,799,662

DATED : January 24, 1989

INVENTOR(S) : SEIJI SAGARA, ET AL.

It is certified that error appears in the above-identified patent and that said Letters Patent is hereby corrected as shown below:

feed rollers and therefore preventing sheet deviation to prevent creasing, wrinkling or tearing of the sheet--.

Signed and Sealed this

Sixth Day of June, 1989

*Attest:*

*Attesting Officer*

DONALD J. QUIGG

*Commissioner of Patents and Trademarks*